US006852180B1

(12) United States Patent
Faral et al.

(10) Patent No.: US 6,852,180 B1
(45) Date of Patent: Feb. 8, 2005

(54) METHOD FOR MAKING CARBON STEEL BANDS, IN PARTICULAR PACKAGING STEEL BANDS, AND RESULTING BANDS

(75) Inventors: Michel Faral, Metz (FR); Michel Guttmann, Samois sur Seine (FR); Jean-Hubert Schmitt, Montigny les Metz (FR); Catherine Juckum, Paris (FR); Helene Regle, Corny sur Moselle (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 10/088,176

(22) PCT Filed: Sep. 20, 2000

(86) PCT No.: PCT/FR00/02597

§ 371 (c)(1),
(2), (4) Date: Jun. 17, 2002

(87) PCT Pub. No.: WO01/21844

PCT Pub. Date: Mar. 29, 2001

(30) Foreign Application Priority Data

Sep. 24, 1999 (FR) ..... 99 11925

(51) Int. Cl.[7] ..... C21D 8/02

(52) U.S. Cl. ..... 148/547; 148/541; 148/661; 148/650; 148/651

(58) Field of Search ..... 148/541, 547, 148/661, 650, 651

(56) References Cited

U.S. PATENT DOCUMENTS 5,178,687 A * 1/1993 Miyakusu et al. ..... 148/325
6,109,336 A * 8/2000 Pronk et al. ..... 148/541

FOREIGN PATENT DOCUMENTS

| | | |
|---|---|---|
| DE | 23 57 443 | 5/1974 |
| EP | 0 572 666 | 12/1993 |
| EP | 0 776 984 | 6/1997 |

OTHER PUBLICATIONS

Patent Abstracts of Japan, vol. 1995, No. 8, Sep. 29, 1995.

* cited by examiner

*Primary Examiner*—Deborah Yee
(74) *Attorney, Agent, or Firm*—Sughrue Mion, PLLC

(57) ABSTRACT

The invention relates to the iron and steel industry. More specifically, the invention describes the manufacture of steel strip intended to be converted into thin packaging, such as for drinks and preserved food.

29 Claims, No Drawings

METHOD FOR MAKING CARBON STEEL BANDS, IN PARTICULAR PACKAGING STEEL BANDS, AND RESULTING BANDS

BACKGROUND OF THE INVENTION

The invention relates to the iron and steel industry. More specifically, it relates to the manufacture of steel strip intended to be converted into thin packaging, such as for drinks and preserved food.

DESCRIPTION OF THE PRIOR ART

The conventional process for manufacturing steel strip intended subsequently to be converted into thin packaging, especially for drinks and food products, comprises the following steps:

- continuous casting of a carbon steel slab;
- hot rolling of this slab on a strip-rolling mill with an end-of-rolling temperature above the $Ar_3$ temperature of the grade in question;
- cold rolling of the hot strip thus obtained, this cold rolling possibly being carried out in a single step, or in two steps possibly separated by a heat treatment, depending on the desired final thickness of the strip; and
- annealing of the cold strip thus obtained, by box annealing or continuous annealing.

In practice, the thicknesses of the final strip after cold rolling and annealing are about 0.09 to 0.40 mm. This strip is then cut into sheets and/or blanks, which are drawn in order to form the desired packaging.

This manufacturing sequence is long and expensive in terms of energy, because of the fact that it requires the use of separate plants. In particular, slab rolling on a strip-rolling mill is expensive, especially because such a slab has to be reheated to a high temperature. Moreover, the strip-rolling mill is a plant requiring a high investment.

This drawback may be obviated by replacing the entire system—continuous casting plant/reheat furnace/strip-rolling mill—by a plant for the direct casting of thin strip having a thickness of less than 10 mm. This solution was proposed in document JP 09-001207, which teaches the direct casting, from liquid metal, in a casting plant between two internally cooled counter rotating rolls of strip whose composition corresponds to a conventional grade of packaging steel (C %≦0.15; Mn %≦0.6; P %≦0.025; S %≦0.025; Al %≦0.12%; N %≦0.01; $O_{total}$%≦0.007%, all these contents being expressed as percentages by weight). The strip thus cast then undergoes a pickling operation, a first cold rolling operation, a recrystallization annealing operation and a second cold rolling operation. In the cold rolling, the total reduction ratio undergone by the strip is between 85 and 95% if it is desired to obtain satisfactory results with regard to the level of drawing ears, the anisotropic coefficient $\bar{r}$ and the planar anisotropy Ar. The twin-roll casting may be followed by a light hot rolling with a reduction ratio of 20 to 50%, or more. The manufacture of the hot strip, which must then undergo the cold rolling and the associated treatments, is thus more rapid and more economic. However, the need to carry out thereafter a cold rolling operation in two steps separated by an annealing operation tempers these advantages.

SUMMARY OF THE INVENTION

The object of the invention is to provide a process which is more economic than the processes known for obtaining cold-rolled steel strip able to be used to manufacture packaging, especially food packaging such as drinks cans.

For this purpose, the subject of the invention is a process for manufacturing carbon steel strip, especially steel strip for packaging, in which:

- a steel having a composition suitable for use as packaging steel is cast in the form of a thin strip from 0.7 to 10 mm in thickness directly from liquid metal,
- an in-line hot rolling operation is carried out on said strip, at the end of which said steel is in the austenitic range;
- said strip undergoes forced cooling at a rate of 80 to 400° C./s, at the end of which said steel is in the ferritic range;
- said strip undergoes a cold rolling operation with a reduction ratio of at least 85%; and
- said strip undergoes an annealing operation.

The subject of the invention is also a carbon steel strip, especially a steel strip for packaging, characterized in that it can be obtained by the above process.

As will have been understood, the invention relies on the use of a twin-roll casting process followed by at least one in-line hot-rolling step and particular cooling of the strip. A hot strip is thus obtained which then only undergoes a single cold rolling step (apart from the conventional final skin-pass rolling) in order to give it the properties making it suitable for the manufacture of packaging steel.

The invention will be more clearly understood from the description which follows.

The process according to the invention starts with the casting, in the form of thin strip from 0.7 to 10 mm (preferably from 1 to 4 mm) in thickness, of a semifinished product based on a low or ultralow carbon steel which can be used for packaging of conventional composition. This composition, in respect of the main elements present, meets the following principal criteria (the percentages are expressed in percentages by weight): 0%≦C≦0.15%; 0%≦Mn≦0.6%; 0%≦P≦0.025; 0%≦S≦0.05%; 0%≦Al≦0.12%; 0%≦N≦0.04%. This steel furthermore contains typical impurities resulting from the smelting, and possibly alloying elements in small amounts which will not unfavorably affect the properties of the products during their forming and their use as packaging steel (it is thus known, in certain packaging steels, to introduce a few thousandths of a % of boron), the balance being iron. The alloying elements, which in general are absent, may optionally be present in amounts possibly ranging up to 1%—these elements are especially Si, Cr, Ni, Mo and Cu. For regulatory reasons, certain alloying elements must be excluded when the steel is intended for packaging—these elements are, for example, tin, cadmium and arsenic.

The continuous casting of thin strip directly from liquid metal is a technique which has been tried out for many years for casting carbon steel, stainless steel and other ferrous alloys. The technique most widely used for casting thin strip of ferrous alloys, and which is in the process of reaching the industrial stage, is the so-called technique of "twin-roll casting" in which liquid metal is introduced between two closely spaced rolls having horizontal axes, rotating in opposite directions and cooled internally. The casting space is closed off laterally by refractory plates pressed against the plane lateral faces of the rolls. Solidified metal "shells" form on each of the rolls and join in the nip (the region where the distance between the cylindrical lateral surfaces of the rolls is the smallest and corresponds approximately to the desired thickness of the strip) in order to form a solidified strip. This technique is particularly recommended for the invention because it allows strip thicknesses of a few mm to be obtained, and the rest of the description will refer to this technique. However, it is possible to use other direct casting processes for thin strip, such as casting between two moving belts, which allows the casting of slightly thicker products than in twin-roll casting. However, one of the advantages of twin-roll casting is the possibility of obtaining, if necessary, extremely flat thickness profiles over the transverse direction of the strip, thanks to excellent roll crown control that the most advanced methods putting this process into practice allow (see, for example, document EP 0 736 350).

After leaving the rolls, the strip preferably passes through a region such as an enclosure inerted by injecting gas, in which it is subjected to a nonoxidizing environment (an inert nitrogen or argon atmosphere, or even an atmosphere containing a small proportion of hydrogen in order to make it reducing) so as to avoid or limit the formation of scale on its surface. It is also possible to place, downstream of this inerting region, a device for descaling the strip, by blasting its surface with shot or with solid $CO_2$ or by brushing, so as to remove the scale which might have formed despite the precautions taken. It is also possible to choose to leave the scale to form in a natural way, without seeking to inert the atmosphere surrounding the strip, and then to remove this scale by a device such as the one just described. The presence of scale on the strip is not, in general, desirable because of the risk of this scale becoming encrusted in the surface of the strip during the subsequent rolling operations. Such incrustations result in a poor surface finish of the product. In addition, the scale increases the rolling forces to be applied and degrades the surface finish of the rolling mill rolls.

As soon as possible immediately after the strip leaves the inerting or descaling plant, if there is one, the strip undergoes a hot rolling operation followed by strong cooling. The purpose of this treatment is to obtain a strip having:

- a thickness of less than 3 mm (typically 0.9 mm) which, in conjunction with the reduction ratios employed in the cold rolling which follows, allows a finished strip having the desired thickness to be obtained;
- a metallurgical structure which, again in conjunction with the treatments subsequently undergone by the strip, makes it possible for the strip to have the mechanical properties required for the future use of the metal, for example as packaging steel; and
- a transverse profile which is flatter than those obtained with the conventional processes.

To achieve this result, two methods of manufacture are proposed.

According to the first method, a single hot rolling step is carried out on the strip, terminating at a temperature above the $Ar_3$ temperature of the cast steel, in other words in the austenitic range. This hot rolling is carried out with a minimum reduction ratio of 20%, and preferably this ratio is greater than 50%.

The purpose of this hot rolling is two fold:

- to close up any pores that may be present in the core of the strip after it has been cast;
- to "break" the solidification microstructure; and
- to improve this surface finish of the strip by flattening the protuburances which may be present on the surface of the strip, in particular when rolls having a relatively high roughness are used during casting, which roughness may be advantageous in order to optimize the heat transfer between the rolls and the solidified shells.

This single hot-rolling step may be carried out by making the strip pass through a single rolling mill stand. It may also be carried out more gradually by making the strip pass through two or more rolling mill stands. The first stand may, for example, apply a reduction ratio to the strip which is sufficient only to close up the pores and the second stage then applies most of the thickness reduction allowing the two other functions of the hot rolling to be carried out. The essential point is that the overall reduction ratio caused by this pass or these passes through the stand or the successive stands and the temperature of the strip after it has passed through the last stand lie within the ranges or values prescribed.

According to the second of these methods, the hot rolling is carried out in two steps, separated by a reheating operation and possibly by a descaling operation. The first of these steps is carried out either in the austenitic range or in the ferritic range of the cast strip, with a reduction ratio of 20 to 70%. The functions of this first step are identical to those of the single hot-rolling step of the first method and can be carried out by making the strip pass through one or more successive rolling mill stands. Preferably, this first rolling step takes place in the ferritic range when it is desired to obtain a small final strip thickness, as lower forces are needed to deform the strip uniformly over its width when the strip is in the austenitic range. When this first hot rolling step is carried out over several stands, it is conceivable, however, to start this first step in the austenitic range, for example by a relatively light rolling principally for the purpose of closing up the pores, and to finish it in the ferritic range in which the remainder of the thickness reduction is achieved. After this first hot rolling step, the strip is left to cool down into the ferritic range if it is not already therein (if required with the aid of slight forced cooling) and then a reheating heat treatment is applied to it, which brings it back into the austenitic range and therefore above the $Ar_3$ temperature. In this way, an additional phase change is induced in the strip, consequently resulting in an even greater refinement of the grains of the metallurgical structure. The second hot rolling step is then carried out, in the austenitic range, with a reduction ratio of 10 to 30%. This second hot rolling operation has the essential function of correcting the geometrical defects (poor flatness, warp, etc.), that the first hot rolling might cause. The intermediate reheating may be carried out by means of an inductor through which the strip passes. For a strip 0.75 mm in thickness and 850 mm in width running at a speed of 200 m/min, a power of 1.04 MW is needed if a 100° C. temperature rise is desired. Consequently, if a longitudinal-flux solenoid inductor operating at 500 kHz is used, the efficiency of which is usually about 45%, an inductor length of approximately 2 m (including 1.5 m of the working region) is suitable for this use. If the strip has a smaller thickness, it is possible to use the transverse-flux induction heating technology described, for example, in the document "High flux induction for the fast heating of steel semi-product in line with rolling" (Proceedings of the XIII International Congress on Electricity Applications, Birmingham, June 1996). However, in general, other more conventional technologies, such as a muffle furnace in a controlled atmosphere, or radiant tubes, may be used to carry out this reheating.

The two methods that have just been described therefore have in common the fact that they terminate in rolling carried out on the strip in the austenitic phase, which is therefore completed above the $Ar_3$ temperature. In both cases, the process according to the invention continues with strip cooling comprising a forced cooling step at a rate of 80 to 400° C./s, preferably 100 to 300° C./s. This cooling is completed in the ferritic range of the cast steel and in general brings the strip to a temperature close to its coiling temperature. Its purpose is to avoid an excessive growth in the grain size before coiling and during the period in which the strip is in the coiled form. Typically, this coiling temperature is below 750° C. For aluminum-killed grades, the coiling temperature may be chosen to be around 550° C. or 600° C. or 700° C. so as to favor, to a greater or lesser extent, the precipitation of aluminum nitrides.

In order to obtain the desired strip properties reliably, it is important for this forced cooling to take place uniformly over the entire width of the strip. The maximum desirable magnitude of the temperature difference over the width of the strip from one point to another at a given instant may be 10° C. This uniformity is more difficult to guarantee if the cooling rate is high, this being the reason for recommending a maximum rate of 400° C./s. However, a minimum rate of 80° C./s is necessary to ensure that the cooling has the desired metallurgical effectiveness. Such cooling rates may be obtained in particular, by spraying water by means of high-pressure jets, or by spraying a water/air or similar mixture (atomization). This forced cooling may start just after strip rolling in the austenitic range, but it is advisable to start it only after having left the strip to cool at a low rate (approximately 10° C./s, which can be achieved by simply exposing it to the open air) and after it has passed into the ferritic range, and therefore below $Ar_3$. This takes full advantage of the grain refinement associated with the austenite-to-ferrite phase change, whereas rapid cooling starting in the austenitic range would be substantially detrimental to uniformity of the microstructure. However, it should be noted that the accelerated cooling must preferably not start at a temperature below $Ar_3$—10° C.

In general, the use of rapid cooling before coiling prevents the presence of coarse grains in the skin of the strip, which would be particularly undesirable in the case of packaging steel. This is because the latter must have, after cold rolling, a very high level of uniformity of their final characteristics.

The coiled and then uncoiled strip then undergoes a cold rolling operation with a reduction ratio of at least 85%, preferably more than 90%. This cold rolling may be carried out perfectly well in a single reduction, that is to say in a single step, and not necessarily in two steps with intermediate annealing, as was the case in document JP 09-001207 already mentioned (cold rolling with double reduction). A drawability comparable to that obtained by the known processes is obtained and strip thicknesses 0.09 mm less than those in the known processes can be achieved without thereby having to resort to double-reduction cold rolling. If it is not desired to obtain thinner strips than usual, the conventional thicknesses may be obtained with smaller reduction ratios during cold rolling, which is more economic. Of course, it is possible for the strip to undergo double-reduction cold rolling if it is desired to obtain an even smaller thickness or even higher mechanical properties.

As an indication, table 1 gives examples of final thicknesses of the strip according to its initial thickness after casting and of the reduction ratios applied during the hot rolling steps (in one or two steps depending on the method chosen) and the cold rolling.

TABLE 1

| Strip thicknesses obtained according to the various casting and rolling parameters | | | | |
|---|---|---|---|---|
| Thickness of the cast strip (mm) | Hot rolling reduction ratio (%) | Thickness of the hot strip (mm) | Cold rolling reduction ratio (%) | Final thickness of the strip (mm) |
| 3 | 65 | 1.05 | 85 to 92 | 0.158 to 0.084 |
| 3 | 70 | 0.9 | 85 to 92 | 0.135 to 0.072 |
| 2 | 60 | 0.8 | 85 to 92 | 0.12 to 0.064 |
| 1.5 | 50 | 0.75 | 85 to 92 | 0.113 to 0.060 |

After the cold rolling, the strip undergoes the usual (box or continuous) annealing intended to give it its mechanical properties. This annealing may be followed, as usual, by a descaling operation, a coating operation and/or a skin-pass rolling operation.

Since the speeds of the strip leaving the hot rolling mill are about 250 m/min or less, these speeds are compatible with execution in a single line of this rolling mill (and therefore of the casting line in its entirety) and of one or more cold rolling, annealing and cold treatment operations on the packaging steel, the metal throughput of which is compatible with that of the hot rolling mill. As examples of such operations, apart from the descaling and skin-pass rolling which may possibly follow the annealing, mention may be made of lacquering, varnishing, polymer deposition, for example by coextrusion, electron bombardment or plasma vacuum deposition and metal coating by electrodeposition. If the cold rolling operation takes place in line with the casting and hot-rolling operation, this means that the step of coiling the strip is eliminated.

Although a preferred field of application of the invention is in the manufacture of steel strip to be drawn in order to form packaging for drinks or preserved food, it goes without saying that the invention can be applied to the manufacture of steel strip intended for other purposes, for which similar properties would be required of the strip produced.

What is claimed is:

1. A process for manufacturing a carbon steel strip suitable for use as packaging steel, in which:

a steel having a composition suitable for use as packaging steel, wherein said steel contains alloying elements of Si, Cr, Ni, Mo, and Cu present in an amount less than 1%, is cast in the form of a thin strip from 0.7 to 10 mm in thickness, directly from liquid metal;

an in-line hot rolling operation is carried out on said strip, wherein the strip after hot rolling has a thickness of less than 3 mm, and wherein at the end of which said steel is in the austenitic range;

said strip undergoes forced cooling at a rate of 80 to 400° C./s, at both the beginning and the end of which said steel is in the ferritic range;

said strip undergoes a cold rolling operation with a reduction ratio of at least 85%; and said strip undergoes an annealing operation.

2. The process as claimed in claim 1, wherein said cast comprises casting between two internally cooled horizontal rolls rotating in opposite directions.

3. The process as claimed in claim 1, wherein said hot rolling operation is carried out in a single step with a reduction ratio of at least 20%.

4. The process as claimed in claim 3, wherein said hot rolling operation is carried out in a single step with a reduction ratio of at least 50%.

5. A process for manufacturing a carbon steel strip suitable for use as a packaging steel, in which:

a steel having a composition suitable for use as packaging steel, wherein said steel contains alloying elements of Si, Cr, Ni, Mo, and Cu present in an amount less than 1%, and wherein said steel is cast in the form of a thin strip from 0.7 to 10 mm in thickness, directly from liquid metal;

an in-line hot rolling operation is carried out on said strip in two steps, wherein the first step is an in-line hot rolling step carried out in either an austenitic or ferritic range of the cast strip, with a reduction ratio of 20 to 70%, and then cooled down into the ferritic range, if not already in the ferritic range wherein after said first step, the strip is reheated so as to make said steel pass from the ferritic range into the austenitic range, and the second step is an in-line hot rolling step carried out with a reduction ratio of 10 to 30%, at the end of which second step said steel is in the austenitic range.

6. The process as claimed in claim 5, wherein said first step is carried out entirely in the ferritic range of said steel.

7. The process as claimed in claim 5, wherein said first step is carried out partly in the austenitic range and partly in the ferritic range of said steel.

8. The process as claimed in claim 1, wherein after said cast, the strip is made to pass through a region in which it is subjected to a nonoxidizing environment.

9. The process as claimed in claim 1, wherein the strip is subjected to a descaling operation before and/or during the hot rolling.

10. The process as claimed in claim 1, wherein said forced cooling is carried out at a rate of 100 to 300° C./s.

11. The process as claimed in claim 1, wherein the strip is coiled at a temperature below 750° C. between the forced cooling operation and the cold rolling operation.

12. The process as claimed in claim 1, wherein the reduction ratio of the cold rolling is at least 85%.

13. The process as claimed in claim 1, wherein said cold rolling is carried out in a single step.

14. The process as claimed in claim 5, wherein said cast comprises casting between two internally cooled horizontal rolls rotating in opposite directions.

15. The process as claimed in claim 5, wherein said step is carried out with a reduction ratio of at least 20%.

16. The process as claimed in claim 5, wherein said step is carried out with a reduction ratio of at least 50%.

17. The process as claimed in claim 1, wherein the composition of said steel in percentages by weight is:

$0 \leqq C \leqq 0.15\%$;

$0 \leqq Mn \leqq 0.6\%$;

$0 \leqq P \leqq 0.025\%$;

$0 \leqq S \leqq 0.05\%$;

$0 \leqq Al \leqq 0.12\%$;

$0 \leqq N \leqq 0.04\%$;

the balance being iron, smelting impurities and alloying elements in amounts that do not prevent the use of said strip to manufacture packaging steel.

18. The process as claimed in claim 5, wherein the composition of the steel in percentages by weight is:

$0 \leqq C \leqq 0.15\%$;

$0 \leqq Mn \leqq 0.6\%$;

$0 \leqq P \leqq 0.025\%$;

$0 \leqq S \leqq 0.05\%$;

$0 \leqq Al \leqq 0.12\%$;

$0 \leqq N \leqq 0.04\%$;

the balance being iron, smelting impurities and alloying elements in amount that do which do not prevent the use of said strip to manufacture packaging steel.

19. The process according to claim 1, wherein the strip is coiled and then uncoiled before a cold rolling operation.

20. The process according to claim 5, wherein the strip is coiled and then uncoiled before a cold rolling operation.

21. The process according to claim 1, wherein the strip after hot rolling has a thickness of 0.9 mm.

22. The process according to claim 1, wherein said strip undergoes forced cooling at a rate of 100 to 300° C./sec.

23. The process according to claim 5, wherein said strip undergoes forced cooling at a rate of 100 to 300° C./sec.

24. The process according to claim 1, wherein said thin strip is cast from 1 to 4 mm in thickness.

25. The process according to claim 5, wherein said thin strip is cast from 1 to 4 mm in thickness.

26. The process according to claim 17, wherein the alloying elements are not present.

27. The process according to claim 18, wherein the alloying elements are not present.

28. The process according to claim 17, wherein the alloying elements do not contain Sn, Ca, or Ar.

29. The process according to claim 18, wherein the alloying elements do not contain Sn, Ca, or Ar.

* * * * *